US009879476B2

(12) United States Patent
Sung et al.

(10) Patent No.: US 9,879,476 B2
(45) Date of Patent: Jan. 30, 2018

(54) CORDLESS CURTAIN

(71) Applicant: GUANGZHOU GARDEN RUBBER & PLASTIC CO., LTD., Guangzhou, Guangdong (CN)

(72) Inventors: Chou Ho Sung, Guangdong (CN); Bensheng Liu, Guangdong (CN)

(73) Assignee: GUANGZHOU GARDEN RUBBER & PLASTIC CO., LTD., Guangzhou, Guangdong (CN)

( * ) Notice: Subject to any disclaimer, the term of this patent is extended or adjusted under 35 U.S.C. 154(b) by 0 days.

(21) Appl. No.: 15/141,806

(22) Filed: Apr. 28, 2016

(65) Prior Publication Data

US 2017/0218694 A1 Aug. 3, 2017

(30) Foreign Application Priority Data

Feb. 3, 2016 (CN) ..... 2016 1 0078033 A
Feb. 3, 2016 (CN) ..... 2016 2 0112354 U

(51) Int. Cl.
*E06B 9/322* (2006.01)
*E06B 9/323* (2006.01)
*E06B 9/327* (2006.01)

(52) U.S. Cl.
CPC ..... *E06B 9/322* (2013.01); *E06B 9/323* (2013.01); *E06B 9/327* (2013.01); *E06B 2009/3222* (2013.01)

(58) Field of Classification Search
CPC .... E06B 9/322; E06B 2009/323; E06B 9/327; E06B 2009/3222; E06B 9/262; E06B 2009/2622; E06B 2009/2625; E06B 2009/2627
USPC ..... 160/370, 171, 84.01, 84.04, 84.05
See application file for complete search history.

(56) References Cited

U.S. PATENT DOCUMENTS 5,477,904 A * 12/1995 Yang ..... B60J 1/2091 160/370.23
7,398,815 B2 * 7/2008 Liang ..... E06B 9/262 160/170
7,487,817 B2 * 2/2009 Liang ..... E06B 9/32 160/170

(Continued)

FOREIGN PATENT DOCUMENTS

CN 201650088 U 11/2010
CN 201771408 U 3/2011

(Continued)

OTHER PUBLICATIONS

Song et al., English translation of "CN204677095", Sep. 30, 2015. Accessed from <https://worldwide.espacenet.com>.*

(Continued)

*Primary Examiner* — Katherine W Mitchell
*Assistant Examiner* — Johnnie A. Shablack
(74) *Attorney, Agent, or Firm* — U.S. Fairsky LLP; Yue Xu

(57) ABSTRACT

A cordless curtain includes a stretchable component, a movable guide-line sliding assembly, a guide-line fixing seat assembly and a traction cord. One end of the stretchable component is fixed, and another end of the stretchable component is connected to the guide-line sliding assembly; the position of the guide-line fixing seat assembly is fixed and the guide-line fixing seat assembly is connected to the guide-line sliding assembly via the traction cord.

6 Claims, 7 Drawing Sheets

(56) References Cited

U.S. PATENT DOCUMENTS

| | | | | |
|---|---|---|---|---|
| 7,950,437 | B2 * | 5/2011 | Lin | E06B 9/322 160/168.1 R |
| 7,984,745 | B2 * | 7/2011 | Wen | E06B 9/322 160/170 |
| 9,435,154 | B2 * | 9/2016 | Chen | E06B 9/34 |
| 9,441,417 | B2 * | 9/2016 | Shih | E06B 9/262 |
| 9,574,393 | B2 * | 2/2017 | Huang | E06B 9/262 |
| 2006/0137830 | A1 * | 6/2006 | Lin | E06B 9/322 160/84.04 |
| 2006/0137831 | A1 * | 6/2006 | Lin | E06B 9/322 160/84.04 |
| 2007/0119547 | A1 * | 5/2007 | Liang | E06B 9/32 160/170 |
| 2007/0272364 | A1 * | 11/2007 | Liang | E06B 9/322 160/84.05 |
| 2008/0289774 | A1 * | 11/2008 | Ying | E06B 9/323 160/178.1 R |
| 2011/0315329 | A1 * | 12/2011 | Hong | E06B 9/262 160/340 |
| 2014/0069592 | A1 * | 3/2014 | Hsu | E06B 9/38 160/84.05 |
| 2014/0124149 | A1 * | 5/2014 | Ho | E06B 9/303 160/170 |
| 2014/0216664 | A1 * | 8/2014 | Hsu | E06B 9/262 160/84.02 |
| 2015/0041073 | A1 * | 2/2015 | Hsu | E06B 9/262 160/192 |
| 2015/0176329 | A1 | 6/2015 | Chen | |
| 2015/0376940 | A1 * | 12/2015 | Hsu | E06B 9/322 160/169 |
| 2016/0138330 | A1 * | 5/2016 | Huang | E06B 9/262 160/170 |
| 2016/0208549 | A1 * | 7/2016 | Chen | E06B 9/322 |
| 2016/0356081 | A1 * | 12/2016 | Sung | E06B 9/322 |
| 2016/0376839 | A1 | 12/2016 | Huang | |
| 2017/0067287 | A1 * | 3/2017 | Chen | E06B 9/322 |
| 2017/0107075 | A1 * | 4/2017 | Hung | B65H 75/4405 |

FOREIGN PATENT DOCUMENTS

| | | | |
|---|---|---|---|
| CN | 202913926 | U | 5/2013 |
| CN | 204677095 | U | 9/2015 |
| TW | M515021 | U | 1/2016 |

OTHER PUBLICATIONS

Summary of the Chinese 1st Office Action for CN201610078033.7, dated Dec. 12, 2016.

European Search Report for 17152649.4-1614, dated Jul. 11, 2017.

* cited by examiner

CORDLESS CURTAIN

CROSS REFERENCE TO RELATED APPLICATION

The present application claims the benefit of priorities to Chinese patent applications No. 201610078033.7 and No. 201620112354.X both titled "CORDLESS CURTAIN" and filed with the Chinese State Intellectual Property Office on Feb. 3, 2016, the entire disclosures of which are incorporated herein by reference.

FIELD

The present application relates to the technical field of curtains, in particular to a cordless curtain.

BACKGROUND

In a modern living room, curtains are mainly used to provide shade from the sun and privacy protection. At present, there are many kinds of curtains, mainly including corded curtains and cordless curtains. A curtain body of the corded curtain is folded and unfolded by an external pull cord, and the cordless curtain omits the pull cord and is folded or unfolded by applying an upward or downward force at the bottom of the curtain by hand. The cordless curtain mainly includes a curtain body, a driving unit and a traction cord, the driving unit is located at a top side of the curtain body and is connected to the traction cord, and then the traction cord passes through the curtain body of the cordless curtain.

The existing cordless curtains have the following disadvantages, for example the driving unit has a large number of parts and the way of winding of the traction cord on the driving unit is complicated.

SUMMARY

A cordless curtain is provided according to the present application, which is configured to simplify the structure of a driving unit, to simplify the way of winding of a traction cord on the driving unit.

The technical solution of a cordless curtain in an embodiment of the present application includes a stretchable component, a movable guide-line sliding assembly, a guide-line fixing seat assembly and a traction cord, wherein one end of the stretchable component is fixed, and another end of the stretchable component is connected to the guide-line sliding assembly; and the position of the guide-line fixing seat assembly is fixed, and the guide-line fixing seat assembly is connected to the guide-line sliding assembly via the traction cord.

Preferably, in the technical solution of the cordless curtain, the guide-line fixing seat assembly includes at least one first spacer assembly, each first spacer assembly includes a plurality of first spacers arranged at intervals, and each first spacer is provided with a through hole configured to allow a first supporting rod to pass through, the first supporting rod is divided into a plurality of first supporting rod sections by the adjacent first spacers, and the first supporting rod is configured to be wound by the traction cord.

Preferably, in the technical solution of the cordless curtain, the guide-line fixing seat assembly may further include at least one winding assembly, each winding assembly includes a plurality of mounting pieces arranged at intervals, and each of the mounting pieces is provided with a mounting piece through hole configured to allow a second supporting rod to pass through, and the second supporting rod is configured to be wound by the traction cord.

Preferably, in the technical solution of the cordless curtain, a side, connected to the traction cord, of the guide-line sliding assembly is provided with at least one second spacer assembly, each second spacer assembly includes a plurality of second spacers arranged at intervals, and each of the second spacers is provided with a through hole configured to allow a third supporting rod to pass through, the third supporting rod is divided into a plurality of third supporting rod sections by the adjacent second spacers, and the third supporting rod is configured to be wound by the traction cord.

Preferably, in the technical solution of the cordless curtain, a side, connected to the stretchable component, of the guide-line sliding assembly is provided with at least one first hook, and the at least one first hook is connected to the stretchable component.

Preferably, in the technical solution of the cordless curtain, the cordless curtain further includes a guide rail, and each of the stretchable component, the guide-line sliding assembly, the guide-line fixing seat assembly and the traction cord is located in the guide rail.

Preferably, in the technical solution of the cordless curtain, a stretchable-component fixing seat is fixed at the guide rail, at least one second hook is provided on the stretchable-component fixing seat, and the stretchable component is connected to the second hook.

Preferably, in the technical solution of the cordless curtain, a sliding groove is provided in the guide rail and is configured to the guide-line sliding assembly to move therein.

Preferably, in the technical solution of the cordless curtain, the guide-line fixing seat assembly includes at least one fourth supporting rod, and the at least one fourth supporting rod is configured to be wound by the traction cord.

Preferably, in the technical solution of the cordless curtain, the guide-line sliding assembly includes at least one fifth supporting rod, and the at least one fifth supporting rod is configured to be wound by the traction cord.

The above technical solution has the following beneficial effects.

The traction cord, after passing through the curtain body, is wound between the guide-line sliding assembly and the guide-line fixing seat assembly, and one end of the stretchable component is fixed, and another end of the stretchable component is connected to the guide-line sliding assembly, and the guide-line sliding assembly is movable and may stop at a preset position. In the moving process of the guide-line sliding assembly, the stretchable component moves along with the guide-line sliding assembly. When the curtain body is pulled downward, the curtain body is to be unfolded, the traction cord that is pulled downward pulls the guide-line sliding assembly to move in a direction towards the guide-line fixing seat assembly, thus the stretchable component 2 is in a stretched state. When the curtain body is pushed upward, the curtain body is to be folded, the stretchable component tends to return to its original state under the action of an elastic restoring force, thus pulling the guide-line sliding assembly in the opposite direction, i.e., in a direction away from the guide-line fixing seat assembly, thus the curtain body is folded slowly. When the curtain body is stopped at a certain position, the whole cordless curtain is in a state of force balance. The structures of the guide-line sliding assembly and the guide-line fixing seat assembly of the whole cordless curtain are simple, thereby greatly simplifying the way of winding.

BRIEF DESCRIPTION OF THE DRAWINGS

For more clearly illustrating embodiments of the present application or the technical solutions in the conventional technology, drawings referred to describe the embodiments or the conventional technology will be briefly described hereinafter. Apparently, the drawings in the following description are only some examples of the present application, and for the person skilled in the art, other drawings may be obtained based on the provided drawings without any creative efforts.

DETAILED DESCRIPTION

Figure 1:
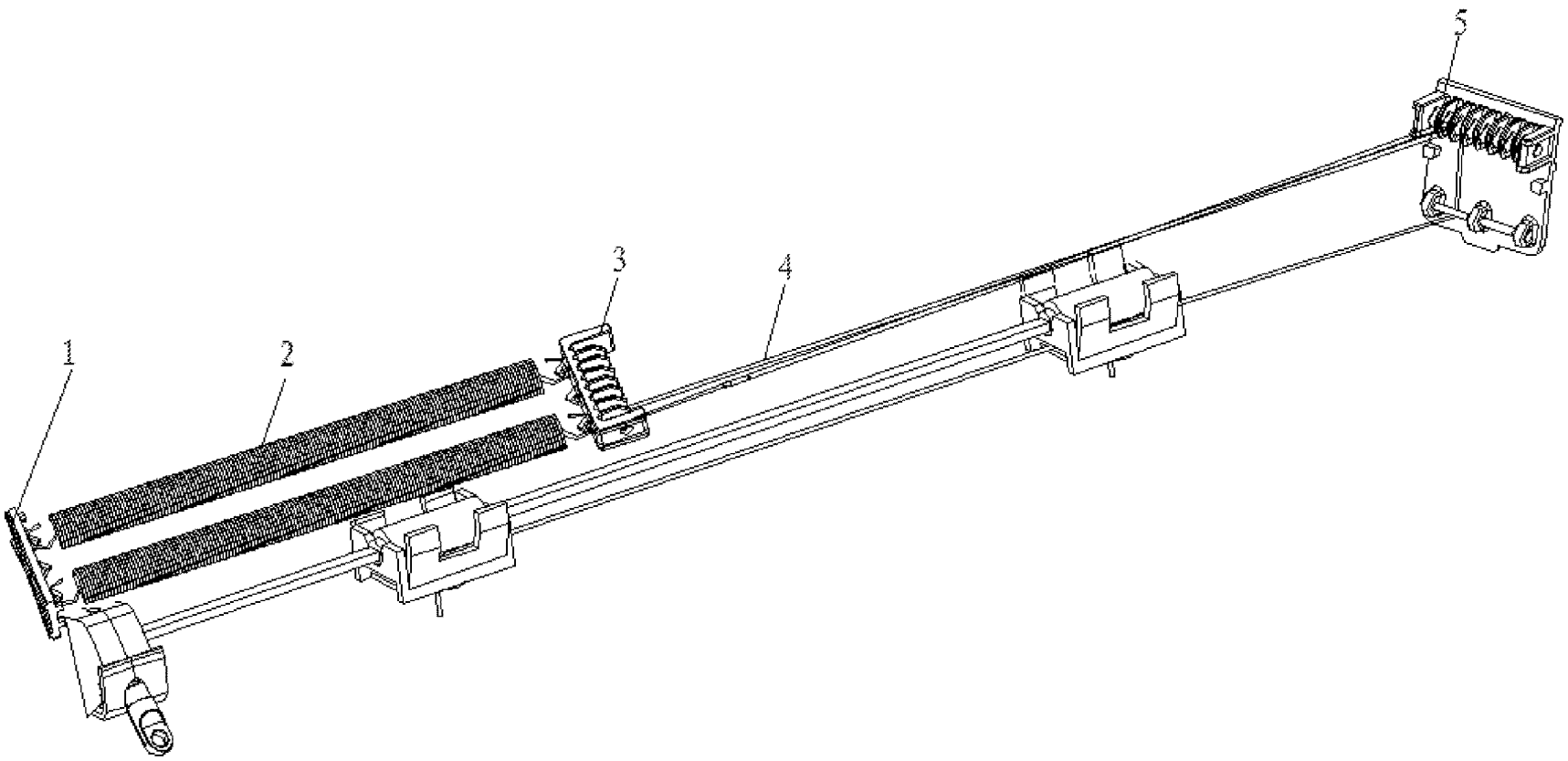
FIG. 1 is a schematic view showing the whole structure of a cordless curtain according to an embodiment of the present application.

A cordless curtain is provided according to the present application, and is configured to simplify the way of winding a traction cord.

The technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the scope of the present application.

First Embodiment

Reference is made to FIGS. 1 to 5. The specific technical solution of a cordless curtain according to the first embodiment of the present application includes a guide-line sliding assembly 3, a stretchable component 2, a guide-line fixing seat assembly 5 and a traction cord 4.

The stretchable component 2 has one fixed end and another end connected to the guide-line sliding assembly 3, and the fixed end may be fixedly connected to the external environment directly. For the convenience of explanation, the end, fixedly connected to the external environment, of the stretchable component 2 is referred to as a first end, and the other end, connected to the guide-line sliding assembly 3, of the stretchable component 2 is referred to as a second end.

The guide-line sliding assembly 3 is movable. The guide-line sliding assembly 3 is movable and may stop at a preset position. Since a side of the guide-line sliding assembly 3 is connected to the stretchable component 2, in the process of moving of the guide-line sliding assembly 3, the first end of the stretchable component 2 is fixed, and the second end of the stretchable component 2 moves with the guide-line sliding assembly 3, thus, when the curtain body is unfolded, the guide-line sliding assembly 3 is pulled by the traction cord 4 to move in a direction approaching the guide-line fixing seat assembly 5, causing the stretchable component 2 to be in a stretched state; and when the curtain body is being folded, the stretchable component 2 returns to its natural state gradually, and the guide-line sliding assembly 3 moves in a direction away from the guide-line fixing seat assembly 5.

The position of the guide-line fixing seat assembly 5 is fixed, and the guide-line fixing seat assembly 5 may be directly fixed to the external environment. The traction cord 4 passing through the curtain body may be wound around the guide-line fixing seat assembly 5 and the guide-line sliding assembly 3 back and forth, and the guide-line fixing seat assembly 5 is connected to the guide-line sliding assembly 3 via the traction cord 4.

With the above technical solution, first, the traction cord 4, after passing through the curtain body, is wound between the guide-line sliding assembly 3 and the guide-line fixing seat assembly 5, and the guide-line sliding assembly 3 is movable and may stop at a preset position. When the curtain body is pulled downward, the traction cord 4 that is pulled downward pulls the guide-line sliding assembly 3 to move in a direction towards the guide-line fixing seat assembly 5, thus stretching the stretchable component 2. When the curtain body is in an unfolded state, the stretchable component 2 is in a stretched state. When the curtain body is pushed upward, the stretchable component 2 tends to return to its original state under the action of an elastic restoring force, thus pulling the guide-line sliding assembly 3 in the opposite direction, i.e., in a direction away from the guide-line fixing seat assembly 5, thus the curtain body is folded slowly. When the curtain body is stopped at a certain position, the whole cordless curtain is in a state of force balance. The structures of the guide-line sliding assembly and the guide-line fixing seat assembly of the whole cordless curtain are simple, thereby greatly simplifying the way of winding.

In the above technical solution of the cordless curtain, the guide-line fixing seat assembly 5 and the guide-line sliding assembly 3 each has various structures. Some structures are described as follows.

(1) Guide-Line Fixing Seat Assembly 5

Figure 2:
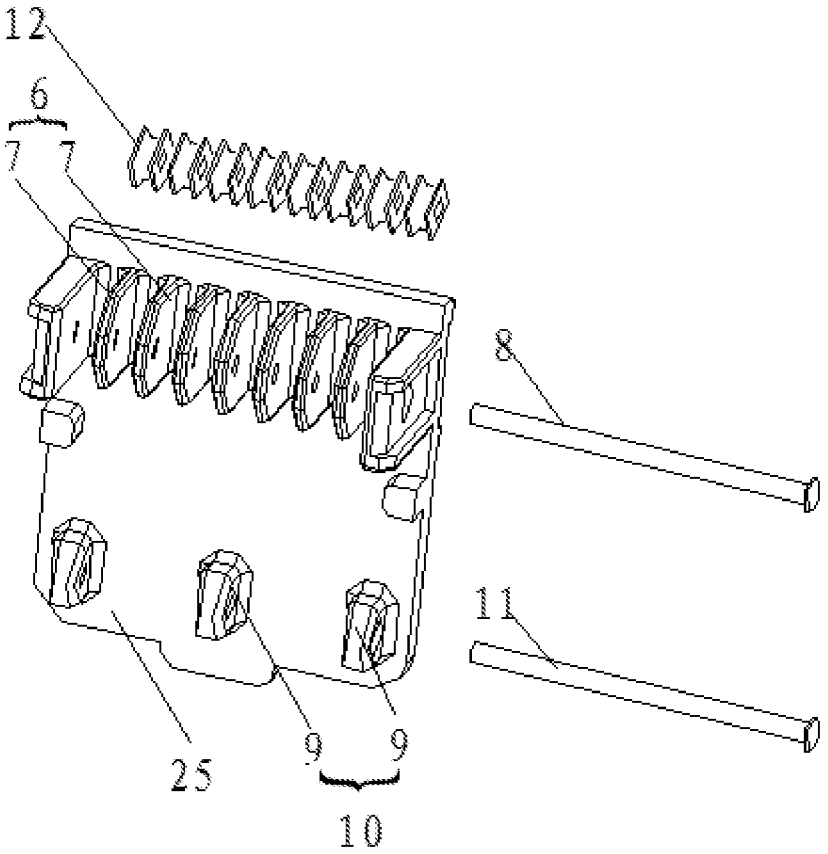
FIG. 2 is an exploded view of a guide-line fixing seat assembly of the cordless curtain shown in FIG. 1.
Figure 3:
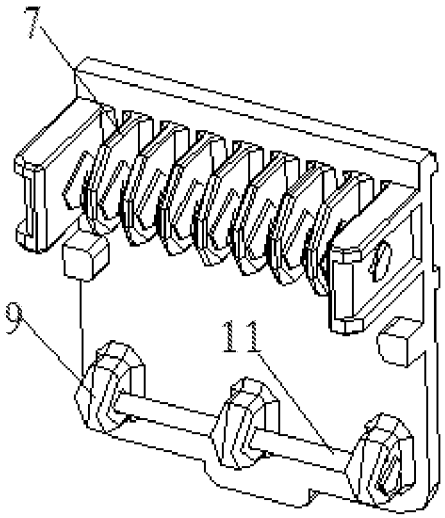
FIG. 3 is a schematic view showing the whole structure of the guide-line fixing seat assembly of the cordless curtain shown in FIG. 2.

As shown in FIGS. 2 and 3, the guide-line fixing seat assembly 5 includes at least one first spacer assembly 6. The first spacer assembly 6 includes a plurality of first spacers 7 arranged at intervals, and each of the first spacers 7 is provided with a through hole configured to allow a first supporting rod 8 to pass through. The first supporting rod 8 passes through the first spacers 7 of the first spacer assembly 6 sequentially, and in this case, the first supporting rod 8 is divided into a plurality of first supporting rod sections by the adjacent first spacers 7, that is, the first supporting rod 8 is divided into a plurality of first supporting rod sections, and each of the first supporting rod sections is located between two adjacent first spacers 7.

Since the guide-line fixing seat assembly 5 of this embodiment includes at least one first spacer assembly 6, the first spacer assembly 6 includes a plurality of first spacers 7 arranged at intervals, each of the first spacers 7 is provided with a through hole configured to allow the first supporting rod 8 to pass through, and the first supporting rod 8 passes through the through holes of all the first spacers 7 and then is divided into a plurality of first supporting rod sections by the adjacent first spacers 7. In this case, the traction cord 4 of the cordless curtain may be wound around the plurality of first supporting rod sections at random.

The more the number of times of winding the traction cord 4, the longer the unfolded length of the curtain body. The traction cord 4 is divided by the first spacers 7, thus the divided traction cord sections 4 winding around back and forth will not interfere with one another, and the structure is simple.

The first spacer assembly 6 will be described below.

The first spacer assembly 6 includes a plurality of first spacers 7 arranged at intervals.

In the guide-line fixing seat assembly 5 of this embodiment, the number of the first spacer assemblies 6 and the number of winding assemblies 10 are not limited. For example, a plurality of sets of the first spacer assemblies 6 may be provided according to the actual size of the cordless curtain, the plurality of sets of first spacer assemblies 6 may be disposed laterally or vertically. When each set of first spacer assemblies 6 is disposed laterally, the plurality of sets of first spacer assemblies 6 are arrayed in the vertical direction, and the first supporting rods 8 passing through the first spacers 7 are each disposed laterally and arrayed in the vertical direction. When each set of first spacer assemblies 6 are disposed vertically, the plurality of sets of first spacer assemblies 6 are arrayed in the lateral direction, and the first supporting rods 8 passing through the first spacers 7 are each disposed vertically and arrayed in the lateral direction.

A further improvement is made to the first spacer assembly 6 of this embodiment, the first spacer assembly 6 may further include a first roller 12. The first rollers 12 are placed within respective first supporting rod sections, that is, within a plurality of sub-regions of the first supporting rod 8 divided by the first spacers 7. Each of the sub-regions is one first supporting rod section, and one first roller 12 is placed in each of the first supporting rod sections. The first roller 12 may rotate freely on the first supporting rod 8, to facilitate pulling the traction cord 4 of the cordless curtain in the first spacer assembly 6, thereby making the operation more effortless.

In the cordless curtain of this embodiment, the number and the arraying direction of the first spacer assemblies 6 are not limited. Whether each set of first spacer assemblies 6 is arranged vertically or laterally, the plurality of sets of first spacer assemblies 6 may be arranged at equal intervals. Further, in the cordless curtain of this embodiment, the number of the first spacers 7 in each first spacer assembly 6 is not limited, and in each first spacer assembly 6, the adjacent first spacers 7 may be arranged at equal intervals.

As shown in FIGS. 2 and 3, a further improvement may be made to the guide-line fixing seat assembly 5 of this embodiment. The guide-line fixing seat assembly 5 may further include at least one winding assembly 10.

The winding assembly 10 may have the following structure. The winding assembly 10 includes a plurality of mounting pieces 9 arranged at intervals, and each of the mounting pieces 9 is provided with a mounting piece through hole configured to allow a second supporting rod 11 to pass through. The second supporting rod 11 is divided into a plurality of individual sub-regions by the adjacent mounting pieces 9, that is, the second supporting rod 11 is divided into a plurality of second supporting rod sections, and each of the second supporting rod sections is located between two adjacent mounting pieces 9. The traction cord 4 passing through the curtain body is first wound around the second supporting rod sections and then wound around the first supporting rod sections, and then the traction cord 4 wound around the first supporting rod sections are then wound around the guide-line sliding assembly 3. Thus, the winding assembly 10 functions to guide the traction cord 4.

Since in the cordless curtain of this embodiment, the number and the arraying direction of the first spacer assemblies 6 are not limited, a plurality of sets of the winding assemblies 10 may be also provided according to the actual size of the cordless curtain. The plurality of sets of winding assemblies 10 may be disposed laterally or vertically. When each set of winding assemblies 10 are disposed laterally, the plurality of sets of winding assemblies 10 are arrayed in the vertical direction, and the second supporting rods 11 passing through the mounting pieces 9 are each disposed laterally and are arrayed in the vertical direction. When each set of winding assemblies 10 are disposed vertically, the plurality of sets of winding assemblies 10 are arrayed in the lateral direction, and the second supporting rods 11 passing through the mounting pieces 9 are each disposed vertically and are arrayed in the lateral direction. Further, when a plurality of sets of the winding assemblies 10 is provided, whether each winding assembly 10 is arranged vertically or laterally, the adjacent winding assemblies 10 may be arranged at equal intervals. In one of the winding assemblies 10, the adjacent mounting pieces 9 may also be arranged at equal intervals.

Further, each of the first supporting rod 8 and the second supporting rod 11 may be in a form of cylinder, to facilitate pulling the traction cord 4 of the cordless curtain.

Based on the above description, as shown in FIGS. 2 and 3, the guide-line fixing seat assembly 5 may have the following structure. The guide-line fixing seat assembly 5 includes a baseplate 25. The first spacer assembly 6 is arranged perpendicularly on the baseplate 25, that is, the plurality of first spacers 7 of the first spacer assembly 6 are arranged perpendicularly on the baseplate 25. Two ends of the baseplate 25 respectively include two fixing ends configured to fix the first supporting rod 8. The first spacers 7 of the first spacer assembly 6 are evenly arranged between the two fixing ends, and the first supporting rod 8 is divided into a plurality of first supporting rod sections by the first spacers 7, the first rollers 12 are placed within the respective first supporting rod sections. The winding assembly 10 is arranged perpendicularly on the baseplate 25, that is, the mounting pieces 9 of the winding assembly 10 are arranged perpendicularly on the baseplate 25, and the second supporting rod 11 passes through the mounting pieces 9 and is fixed to the mounting pieces 9.

(2) Guide-Line Sliding Assembly 3

Figure 4:
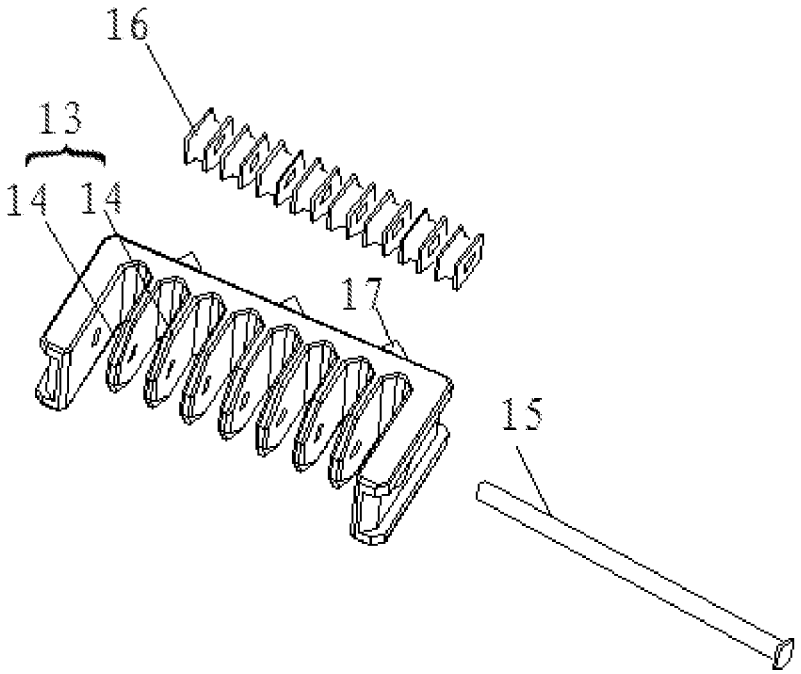
FIG. 4 is an exploded view of a guide-line sliding assembly of the cordless curtain shown in FIG. 1.
Figure 5:
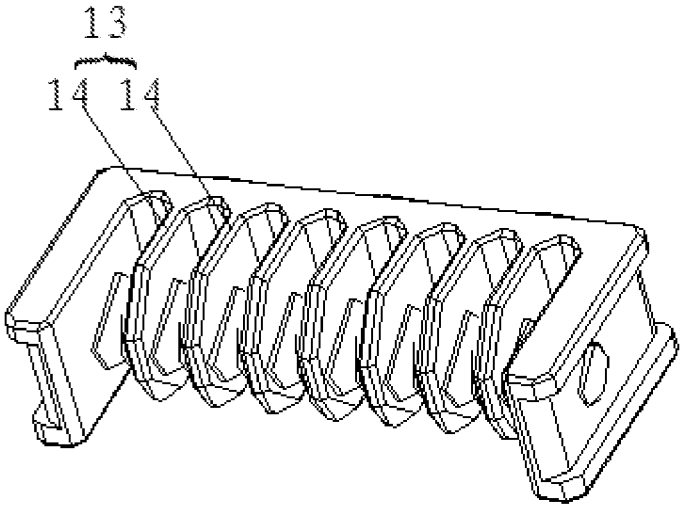
FIG. 5 is a schematic view showing the whole structure of the guide-line sliding assembly of the cordless curtain shown in FIG. 4.

As shown in FIGS. 4 and 5, a side, connected to the traction cord 4, of the guide-line sliding assembly 3 is provided with at least one second spacer assembly 13. The second spacer assembly 13 includes a plurality of second spacers 14 arranged at intervals, and each of the second spacers 14 is provided with a through hole configured to allow a third supporting rod 15 to pass through. The third supporting rod 15 passes through the second spacers 14 of the second spacer assembly 13 sequentially, and then the third supporting rod 15 is divided into a plurality of third supporting rod sections by the adjacent second spacers 14, that is, the third supporting rod 15 is divided into a plurality of third supporting rod sections, and each of the third supporting rod sections is located between two adjacent second spacers 14.

Since the guide-line sliding assembly 3 of this embodiment includes at least one second spacer assembly 13, the second spacer assembly 13 includes a plurality of second spacers 14 arranged at intervals, each of the second spacers 14 is provided with a through hole configured to be allow the third supporting rod 15 to pass through, and the third supporting rod 15 passes through the through holes of the second spacers 14 and then is divided into a plurality of third supporting rod sections by the adjacent second spacers 14, in this case, the traction cord 4 of the cordless curtain may be wound around the plurality of third supporting rod sections at random. The more the number of times of winding the traction cord 4, the longer the unfolded length of the curtain body. The traction cord 4 is divided by the second spacers 14, thus the divided traction cord sections 4 winding around back and forth will not interfere with one another, thus the structure is simple.

The second spacer assembly will be described in detail below.

In the guide-line sliding assembly 3 of this embodiment, the number of the second spacer assemblies 13 is not limited. For example, a plurality of sets of the second spacer assemblies 13 may be provided according to the actual size of the cordless curtain, the plurality of sets of second spacer assemblies 13 may be disposed laterally or vertically. When each set of second spacer assemblies 13 is disposed laterally, the plurality of sets of second spacer assemblies 13 are arrayed in the vertical direction, and the third supporting rods 15 passing through the second spacers 14 are each disposed laterally and are arrayed in the vertical direction. When each set of second spacer assemblies 13 is disposed vertically, the plurality of sets of second spacer assemblies 13 are arrayed in the lateral direction, and the third supporting rods 15 passing through the second spacers 14 are each disposed vertically and are arrayed in the lateral direction.

Further, in the case that a plurality of sets of the second spacer assemblies 13 are provided, whether each second spacer assembly 13 is disposed vertically or laterally, the adjacent second spacer assemblies 13 are arranged at equal intervals. In one of the second spacer assemblies 13, the adjacent second spacers 14 are also arranged at equal intervals.

Further, the guide-line sliding assembly 3 may further include a second roller 16. The second rollers 16 are placed within the respective third supporting rod sections, that is, within a plurality of sub-regions of the third supporting rod 15 divided by the second spacers 14. Each of the sub-regions corresponds to one third supporting rod section, and one second roller 16 is provided within each of the third supporting rod sections. The second roller 16 may rotate freely on the third supporting rod 15, to facilitate pulling the traction cord 4 of the cordless curtain in the second spacer assembly 13, thereby making the operation effortless.

The guide-line sliding assembly 3 is not only connected to the guide-line fixing seat assembly 5, but also connected to the stretchable component 2, and a side, connected to the stretchable component 2, of the guide-line sliding assembly 3 is provided with at least one first hook 17. A plurality of the first hooks 17 may be provided according to actual requirements, to meet the requirement in the case that the cordless curtain is provided with a plurality of stretchable components 2. The first hook 17 may be also arranged laterally or vertically, and the first hook 17 is connected to the stretchable component 2.

Based on the above description, as shown in FIGS. 4 and 5, the guide-line sliding assembly 3 may have the following structure. The guide-line sliding assembly 3 includes a baseplate. The second spacer assembly 13 is arranged perpendicularly on the baseplate, that is, the plurality of second spacers 14 of the second spacer assembly 13 are arranged perpendicularly on the baseplate. Two ends of the baseplate respectively include two fixing ends configured to fix the third supporting rod 15. The second spacers 14 of the second spacer assembly 13 are evenly arranged between the two fixing ends, and the third supporting rod 15 may be divided into a plurality of third supporting rod sections by the second spacers, and rollers 16 are sleeved on the third supporting rod sections. The first hook 17 is also arranged perpendicularly on the baseplate, and the first hook 17 and the second spacer assembly 13 are respectively arranged on the front surface and the back surface of the baseplate.

It should be noted that in this embodiment, the guide-line sliding assembly 3, the stretchable component 2 and the guide-line fixing seat assembly 5 may be arranged in an upper rail of the curtain body, and may be also arranged in a lower rail of the curtain body. The specific mounting positions of the above components are not limited, as long as the curtain body can be folded and unfolded.

It should be noted that in this embodiment, the stretchable component 2 will be pulled by a certain distance in advance in the case that the curtain body is completely folded. When the stretchable component 2 is pulled by a certain distance, the stretchable component 2 is in a stretched state and the traction cord 4 is in a tightened state, thereby making the operation of pulling the curtain body downward or pushing the curtain body upward more effortless.

In the first embodiment, it should be noted that the first spacer assembly 6 and the second spacer assembly 13 may have the same structure, and the terms "first" and "second" are only used to distinguish the names and do not have the actual meaning. Similarly, the first spacer 7 and the second spacer 14 may also have the same structure, and the terms "first" and "second" are only used to distinguish the names and do not have the actual meaning. Similarly, the first supporting rod 8, the second supporting rod 11 and the third supporting rod 15 may also have completely the same structure and may have cylindrical shapes with the same shape and size, and the terms "first" and "second" are only used to distinguish the names, and do not have the actual meaning.

Second Embodiment

Figure 6:
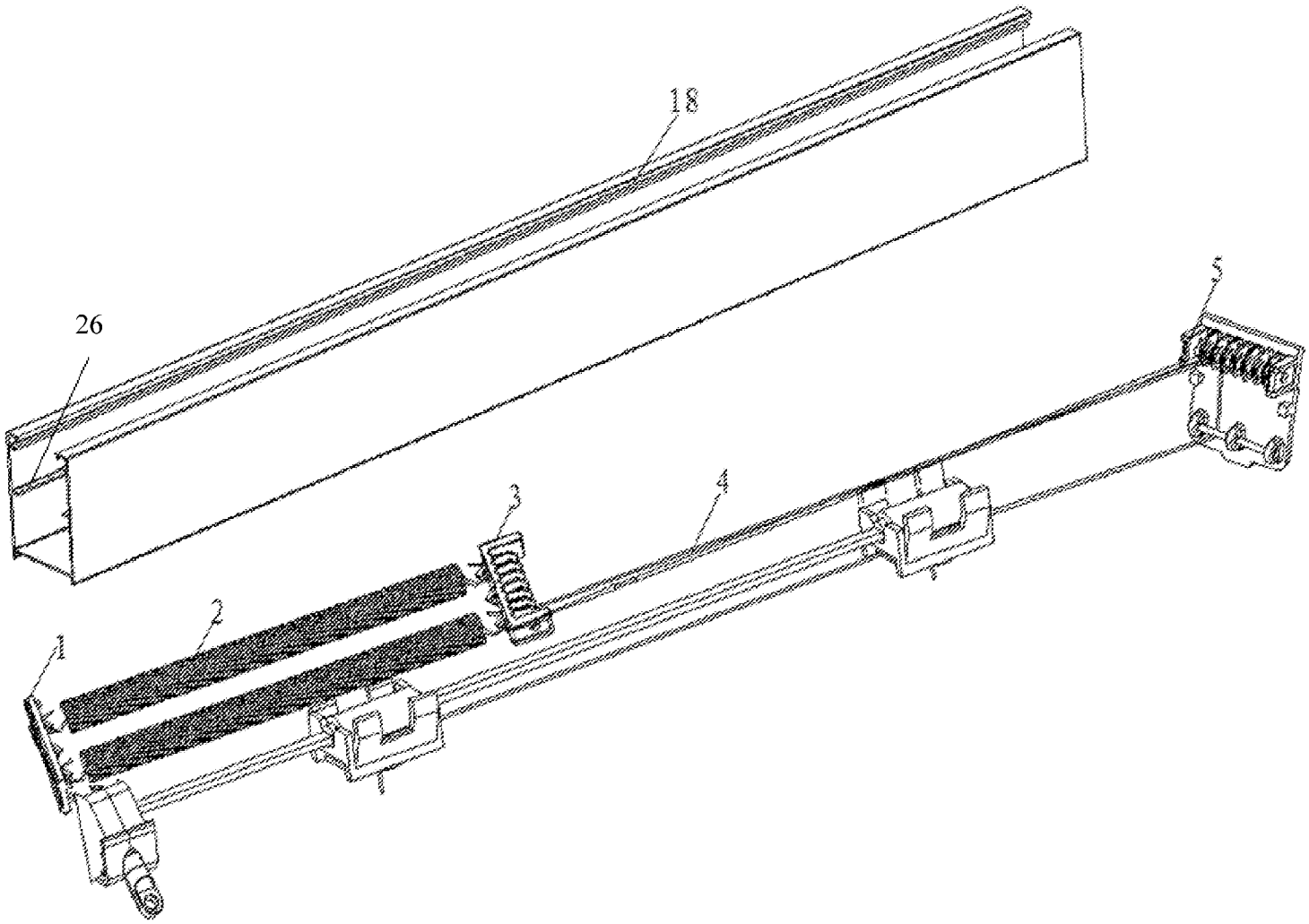
FIG. 6 is a schematic view showing the whole structure of a cordless curtain according to another embodiment of the present application.
Figure 7:
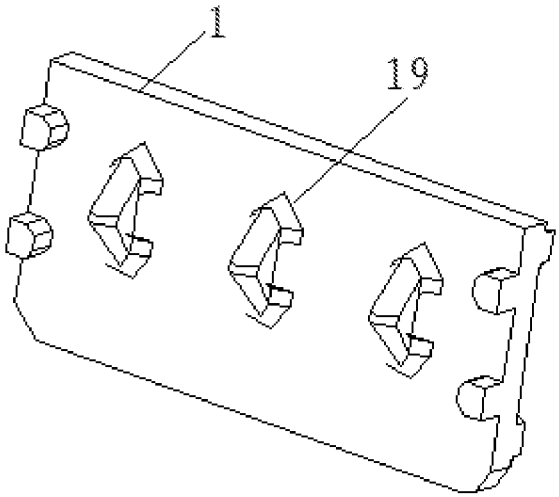
FIG. 7 is a schematic view showing the structure of a stretchable-component fixing seat of the cordless curtain shown in FIG. 6.

Reference is made to FIGS. 6 and 7. The technical solution of a cordless curtain in the second embodiment is described as follows. The cordless curtain includes a guide rail 18, a guide-line sliding assembly 3, a stretchable component 2, a guide-line fixing seat assembly 5 and a traction cord 4. The guide-line sliding assembly 3, the stretchable component 2, the guide-line fixing seat assembly 5 and the traction cord 4 have been described in detail in the first embodiment, and will not be described again in the second embodiment.

The guide rail 18 is provided with a sliding groove 26 configured to allow the guide-line sliding assembly 3 to move therein, and the guide-line sliding assembly 3 is movable in the sliding groove 26. The position of the guide-line fixing seat assembly 5 is fixed, and the guide-line fixing seat assembly 5 may be fixed at any location of the guide rail 18, and the fixing position is not limited to the outmost end of the guide rail 18.

As shown in FIGS. 6 and 7, an end of the guide rail 18 may be provided with a stretchable-component fixing seat 1. The stretchable-component fixing seat 1 is fixed to the guide rail 18, and the fixing position is not limited to the outmost end of the guide rail 18. At least one second hook 19 is provided on the stretchable-component fixing seat 1. The stretchable component 2 has one end connected to the second hook 19, and another end connected to the first hook of the guide-line sliding assembly 3. In this embodiment, the number of the second hooks 19 is also not limited, and a plurality of the second hooks 19 may be provided according to actual requirements, to meet the requirement in the case that the cordless curtain has a plurality of stretchable components 2. Also, the second hook 19 may be arranged laterally or vertically.

The first hook and the second hook 19 may be circular rings respectively fixed to the guide-line sliding assembly 3 and the stretchable-component fixing seat 1. Two ends of the stretchable component 2 are respectively hooked to the circular rings, to allow one end of the stretchable component 2 to be fixedly connected to the stretchable-component fixing seat 1 and the other end of the stretchable component 2 to be connected to the guide-line sliding assembly 3.

It should be noted that in this embodiment, the stretchable component 2 may be a spring or a rubber band, and the stretchable component 2 may also be made of other materials with flexibility, which will not be limited here.

Similar to the first embodiment, the guide-line sliding assembly 3, the stretchable component 2 and the guide-line fixing seat assembly 5 presenting the second embodiment may be arranged in the upper rail of the curtain body, and may be also arranged in the lower rail of the curtain body. The specific positions will not be limited.

By employing the above technical solution, the curtain body can be moved upward or downward, and the cordless curtain is suitable for pleated blinds, organ shades, venetian blinds, Roman blinds and etc.

Third Embodiment

Reference is made to FIGS. 8 to 11. The specific technical solution of a cordless curtain in the third embodiment includes a guide-line sliding assembly, a stretchable component, a guide-line fixing seat assembly and a traction cord.

The stretchable component has one end fixed and another end connected to the guide-line sliding assembly, and the fixed end may be fixedly connected to the external environment directly.

The guide-line sliding assembly is movable. The guide-line sliding assembly is movable and may stop at a preset position. Since a side of the guide-line sliding assembly is connected to the stretchable component, in the process of moving of the guide-line sliding assembly, one end of the stretchable component is fixed, and the other end of the stretchable component moves with the guide-line sliding assembly, thus, when the curtain body is in an unfolded state, the guide-line sliding assembly is pulled by the traction cord to move in a direction towards the guide-line fixing seat assembly, causing the stretchable component to be in a stretched state; and when the curtain body is being folded, the stretchable component returns to its natural state gradually, causing the guide-line sliding assembly to move in a direction away from the guide-line fixing seat assembly.

The position of the guide-line fixing seat assembly is fixed, and the guide-line fixing seat assembly may be directly fixed to the external environment. The traction cord passing through the curtain body may be wound around the guide-line fixing seat assembly and the guide-line sliding assembly back and forth, and the guide-line fixing seat assembly is connected to the guide-line sliding assembly via the traction cord.

By employing the technical solution described above, first, the traction cord, after passing through the curtain body, winds around the guide-line sliding assembly and the guide-line fixing seat assembly, and the guide-line sliding assembly is movable and may stop at a preset position. When the curtain body is pulled downward, the traction cord that is pulled downward pulls the guide-line sliding assembly to move in a direction towards the guide-line fixing seat assembly, thus stretching the stretchable component. When the curtain body is in an unfolded state, the stretchable component is in a stretched state. When the curtain body is pushed upward, the stretchable component tends to return to its original state under the action of an elastic restoring force, to pull the guide-line sliding assembly in the opposite direction, i.e., in a direction away from the guide-line fixing seat assembly, thereby folding the curtain body slowly. When the curtain body is stopped at a certain position, the whole cordless curtain is in a state of force balance. The structures of the guide-line sliding assembly and the guide-line fixing seat assembly of the whole cordless curtain are simple, thereby greatly simplifying the way of winding the traction cord.

Except for the structures of the guide-line fixing seat assembly and the guide-line sliding assembly, the whole structure of the cordless curtain in the third embodiment is the same as that in the first and second embodiments. The guide-line fixing seat assembly and the guide-line sliding assembly in the third embodiment will be described hereinafter.

Figure 8:
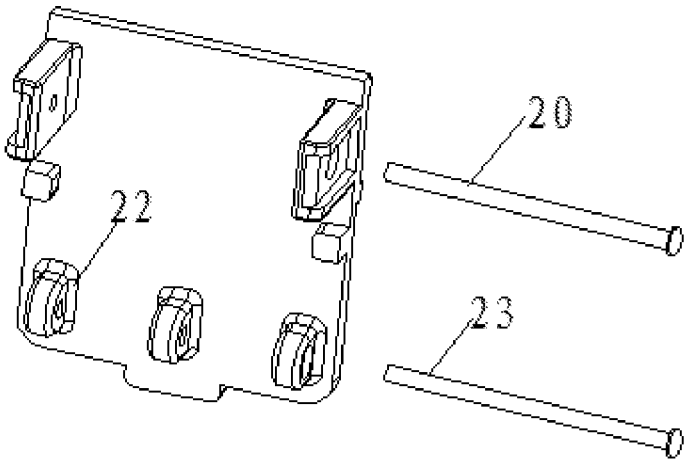
FIG. 8 is an exploded view of a guide-line fixing seat assembly of the cordless curtain according to another embodiment of the present application.
Figure 9:
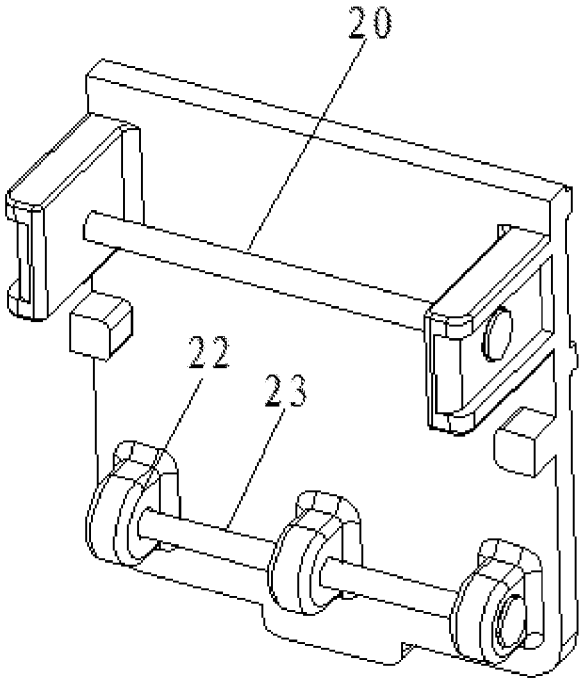
FIG. 9 is a schematic view showing the whole structure of the guide-line fixing seat assembly shown in FIG. 8.

As shown in FIGS. 8 and 9, the guide-line fixing seat assembly may have the following structure. At least one fourth supporting rod 20 is provided in the guide-line fixing seat assembly. The traction cord winds around the fourth supporting rod 20. A plurality of the fourth supporting rods 20 may be provided according to the actual size of the curtain body, and the fourth supporting rod 20 may be disposed laterally or vertically, which is not limited herein.

The guide-line fixing seat assembly may further include a winding assembly. The winding assembly includes a plurality of mounting pieces 22 arranged at intervals, and each of the mounting pieces 22 is provided with a mounting piece through hole configured to allow a sixth supporting rod 23 to pass through. The sixth supporting rod 23 is divided into a plurality of individual sub-regions by the adjacent mounting pieces 22, that is, the sixth supporting rod 23 is divided into a plurality of sixth supporting rod sections, and each of the sixth supporting rod sections is located between two adjacent mounting pieces 22. The traction cord passing through the curtain body first winds around the sixth supporting rod sections and then winds through the fourth supporting rod 20, and then the traction cord wound around the fourth supporting rod 20 winds around the guide-line sliding assembly. The winding assembly functions to guide the traction cord.

The guide-line fixing seat assembly may have the following structure. The guide-line fixing seat assembly may include a baseplate. Two fixing ends are perpendicularly provided on the baseplate. The fourth supporting rod 20 passes through the fixing ends and is fixed at the fixing ends. A mounting piece 22 is also perpendicularly provided on the baseplate. The sixth supporting rod 23 passes through the mounting piece 22 and is fixed in the mounting piece 22. The fixing ends and the mounting piece 22 on the baseplate are located on the same surface of the baseplate.

Figure 10:
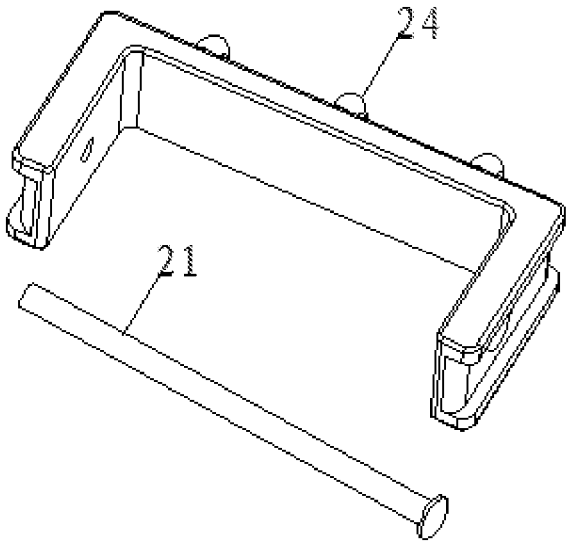
FIG. 10 is an exploded view of a guide-line sliding assembly of the cordless curtain according to another embodiment of the present application.
Figure 11:
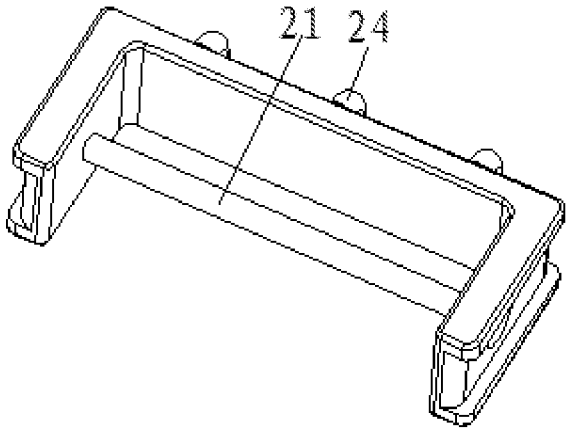
FIG. 11 is a schematic view showing the whole structure of the guide-line sliding assembly shown in FIG. 10.

As shown in FIGS. 10 and 11, the guide-line sliding assembly may have the following structure.

At least one fifth supporting rod 21 is provided on a side, connected to the traction cord, of the guide-line sliding assembly. The traction cord winds around the fifth supporting rod 21. A plurality of the fifth supporting rods 21 may be provided according to the actual size of the curtain body, and the fifth supporting rod 21 may be disposed laterally or vertically, which is not limited herein.

The guide-line sliding assembly is not only connected to the guide-line fixing seat assembly, but also connected to the stretchable component, and a side, connected to the stretchable component, of the guide-line sliding assembly is provided with at least one third hook 24. A plurality of the third hooks 24 may be provided according to actual requirements, to meet the requirement in the case that the cordless curtain has a plurality of stretchable components. The third hook 24 may be also disposed laterally or vertically, and the third hook 24 is connected to the stretchable component.

The guide-line sliding assembly may have the following structure. The guide-line sliding assembly may include one baseplate. Two fixing ends are perpendicularly provided on the baseplate. The fifth supporting rod 21 passes through the fixing ends and is fixed in the fixing ends. A third hook 24 is perpendicularly provided on another side of the baseplate. The fixing ends on the baseplate and the third hook 24 are respectively located on the front surface and the back surface of the baseplate.

The present application has been described in detail above. Based on the conception of the embodiments of the present application, a few of modifications may be made to the specific embodiments and application by the person skilled in the art. In conclusion, the content of the description should not be deemed as limitation to the present application.

What is claimed is:

1. A cordless curtain, comprising a stretchable component, a movable guide-line sliding assembly, a guide-line fixing seat assembly and a traction cord, wherein one end of the stretchable component is fixed, and another end of the stretchable component is connected to the guide-line sliding assembly; and the position of the guide-line fixing seat assembly is fixed, and the guide-line fixing seat assembly is connected to the guide-line sliding assembly via the traction cord;

wherein, the guide-line fixing seat assembly comprises at least one first spacer assembly, each first spacer assembly comprises a plurality of first spacers arranged at intervals, and each of the first spacers is provided with a first spacer through hole, and a first supporting rod passes through the first spacer through hole of each of the first spacers, the first supporting rod is divided into a plurality of first supporting rod sections by the adjacent first spacers, and the traction cord is wound onto the first supporting rod; and wherein, the guide-line fixing seat assembly further comprises at least one winding assembly, each winding assembly comprises a plurality of mounting pieces arranged at intervals, and each of the mounting pieces is provided with a mounting piece through hole, a second supporting rod passes through the mounting piece through hole of each of the mounting pieces, the second supporting rod is divided into a plurality of second supporting rod sections by the adjacent mounting pieces, and the traction cord is wound onto the second supporting rod.

2. The cordless curtain according to claim 1, wherein a side, connected to the traction cord, of the guide-line sliding assembly is provided with at least one second spacer assembly, each second spacer assembly comprises a plurality of second spacers arranged at intervals, and each of the second spacers is provided with a second spacer through hole, a third supporting rod passes through the second spacer through hole of each of the second spacers, the third supporting rod is divided into a plurality of third supporting rod sections by the adjacent second spacers, and the traction cord is wound onto the third supporting rod.

3. The cordless curtain according to claim 2, wherein a side, connected to the stretchable component, of the guide-line sliding assembly is provided with at least one first hook, and the at least one first hook is connected to the stretchable component.

4. The cordless curtain according to claim 3, wherein the cordless curtain further comprises a guide rail, and each of the stretchable component, the guide-line sliding assembly, the guide-line fixing seat assembly and the traction cord is located in the guide rail.

5. The cordless curtain according to claim 4, wherein a stretchable-component fixing seat is fixed at the guide rail, at least one second hook is provided on the stretchable-component fixing seat, and the stretchable component is connected to the second hook.

6. The cordless curtain according to claim 5, wherein a sliding groove is provided in the guide rail and is configured to the guide-line sliding assembly to move therein.

* * * * *